US009469015B2

(12) United States Patent
Cuillier De Maindreville et al.

(10) Patent No.: US 9,469,015 B2
(45) Date of Patent: Oct. 18, 2016

(54) IMPREGNATED ROTARY BIT WITH HIGH DENSITY MONOBLOCK CENTER STRUCTURE

(71) Applicant: Varel International, Ind., L.P., Carrollton, TX (US)

(72) Inventors: Bruno Cuillier De Maindreville, Pau (FR); Gilles Gallego, Ibos (FR)

(73) Assignee: VAREL INTERNATIONAL, IND., L.P., Carrollton, TX (US)

( * ) Notice: Subject to any disclaimer, the term of this patent is extended or adjusted under 35 U.S.C. 154(b) by 658 days.

(21) Appl. No.: 13/936,536

(22) Filed: Jul. 8, 2013

(65) Prior Publication Data

US 2015/0008046 A1 Jan. 8, 2015

(51) Int. Cl.

| | |
|---|---|
| ***E21B 10/56*** | (2006.01) |
| ***B24D 18/00*** | (2006.01) |
| ***C22C 1/00*** | (2006.01) |
| ***E21B 10/55*** | (2006.01) |
| ***E21B 10/567*** | (2006.01) |
| ***B22F 3/15*** | (2006.01) |
| ***B22F 7/08*** | (2006.01) |
| *E21B 10/42* | (2006.01) |
| *E21B 10/60* | (2006.01) |
| *B22F 5/00* | (2006.01) |

(52) U.S. Cl.

CPC ..... *B24D 18/0009* (2013.01); *B22F 3/15* (2013.01); *B22F 7/08* (2013.01); *C22C 1/00* (2013.01); *E21B 10/55* (2013.01); *E21B 10/567* (2013.01); *B22F 2005/001* (2013.01); *B22F 2998/10* (2013.01); *B22F 2999/00* (2013.01); *E21B 10/42* (2013.01); *E21B 10/602* (2013.01)

(58) Field of Classification Search

CPC ..... E21B 10/602; E21B 10/567; E21B 10/42

See application file for complete search history.

(56) References Cited

U.S. PATENT DOCUMENTS

| | | | | |
|---|---|---|---|---|
| 4,574,895 | A | 3/1986 | Dolezal et al. | |
| 6,474,425 | B1 | 11/2002 | Truax et al. | |
| 7,814,997 | B2 * | 10/2010 | Aliko | E21B 10/42 175/408 |
| 8,020,640 | B2 * | 9/2011 | Lockwood | C22C 26/00 175/431 |
| 8,100,203 | B2 * | 1/2012 | Lockwood | C22C 26/00 175/433 |
| 8,191,657 | B2 | 6/2012 | Richert et al. | |
| 8,590,645 | B2 * | 11/2013 | Lockwood | C22C 26/00 175/431 |
| 9,103,170 | B2 * | 8/2015 | Durairajan | E21B 10/46 |
| 9,162,345 | B2 * | 10/2015 | de Reynal | E21B 10/00 |
| 2004/0245024 | A1 * | 12/2004 | Kembaiyan | B22F 7/06 175/425 |
| 2009/0283334 | A1 | 11/2009 | Durairajan et al. | |
| 2011/0094341 | A1 * | 4/2011 | Choe | B22F 7/062 76/108.2 |

* cited by examiner

*Primary Examiner* — Nicole Coy

(57) ABSTRACT

A drill bit includes a bit body having an end face for engaging a rock formation. The end face is defined by a HIP pressed center structure formed of a metal matrix impregnated with super abrasive particles. The HIP pressed center structure includes a central region located at a center axis of said drill bit and finger regions extending radially from the central region. The end face is further defined by infiltrated ribs formed of a metal matrix impregnated with super abrasive particles. Certain ones of the infiltrated ribs are configured to form radial extensions from the finger regions of the HIP pressed center structure.

14 Claims, 10 Drawing Sheets

IMPREGNATED ROTARY BIT WITH HIGH DENSITY MONOBLOCK CENTER STRUCTURE

BACKGROUND

1. Technical Field

The present invention relates generally to earth boring bits, and more particularly to a rotary drag bit impregnated with diamond.

2. Description of Related Art

Impregnated drill bits typically employ a cutting face composed of superabrasive cutting particles, such as natural or synthetic diamond grit, dispersed within a matrix of wear-resistant material. As such a drill bit is operated to drill a formation, the matrix and embedded diamond particles wear, worn cutting particles are lost and new cutting particles are exposed. These diamond particles may either be natural or synthetic and may be cast integral with the body of the bit, as in low-pressure infiltration, or may be preformed separately, as in hot isostatic pressure infiltration, and attached to the bit by brazing or furnaced to the bit body during the manufacturing by an infiltration process.

Reference is now made to FIG. 1 which shows a prior art impregnated bit 10. This bit is made with an aggregate of diamond and matrix powder which is infiltrated. The diamond particles are cast within a supporting material to form an abrasive layer. During operation of the drill bit, diamonds within the abrasive layer are gradually exposed as the supporting material is worn away.

It is important that the bit 10 support the movement of fluid in order to remove rock cuttings and cool the cutting surface of the bit. To this end, the cutting face of the impregnated bit includes an arrangement of radially extending fluid channels 12. The fluid channels 12 divide the abrasive surface of the bit 10 into a plurality of distinct raised ribs 14. The abrasive cutting surface of the bit 10 is defined by the top surface of the ribs 14. All or a portion of a rib 14' may be removed at or near the gage of the bit 10 to define a gap 16. The gap 16 provides a wider fluid course than is provided by any one of the fluid channels 12.

A drilling fluid is pumped down the drill string and through a central plenum of the bit 10 to pass out through openings to the cutting surface of the bit. Rock cuttings generated by the abrasive contact of the top surface of the ribs 14 with the formation being cut mix with the drilling fluid to form a slurry. This slurry passes through the fluid channels 12 and gaps 16 to clean and cool the ribs 14 before passing back up to the surface in an annulus formed between the drill string and the drill hole. The presence of a combination of fluid channels 12 and gaps 16 assists in the efficient evacuation of rock cuttings from the bottom of the drill hole.

An impregnated drill bits is typically made from a solid body of matrix material formed by any one of a number of powder metallurgy processes known in the art. During the powder metallurgy process, super abrasive particles and a matrix powder filling a mold cavity are infiltrated with a molten binder material. Upon cooling, the bit body includes the binder material, matrix material, and the super abrasive particles suspended both near and on the surface of the drill bit. The super abrasive particles typically include small particles of natural or synthetic diamond. Synthetic diamond used in diamond impregnated drill bits is typically in the form of single crystals. However, thermally stable polycrystalline diamond (TSP) particles may also be used.

To connect to the drill string, the impregnated bit must include a drill blank/shank. The shank of the bit is supported within the mold cavity along with any necessary former (such as would be used to define holes for fluid passage or the inclusion of diamond impregnated inserts or other cutting structures). The remainder of the cavity is then filled with a charge of tungsten carbide powder. A binder referred to an infiltrant (such as a nickel brass copper based alloy) is placed on top of the charge of tungsten carbide powder. The mold is then heated sufficiently to melt the infiltrant and held at an elevated temperature for a sufficient period to allow the infiltrant to flow into and bind the powder matrix or matrix and segments. A monolithic bit body is accordingly formed.

The center 18 of the face of the impregnated drill bit 10 (at or about the axis of bit rotation) is a critical area of the bit recognized by those skilled in the art to have a durability concern. There is a need in the art for an improved impregnated bit design which addresses the durability concern at the bit center.

SUMMARY

In an embodiment, a drill bit comprises: a bit body; a plurality of ribs extending from the bit body and formed of a first metal matrix impregnated with super abrasive particles; and a monoblock center structure extending from the bit body and formed of a second metal matrix impregnated with super abrasive particles, said monoblock center structure having a central region located at a center axis of said drill bit and a plurality of finger regions extending radially from said central region, each finger region radially aligned with a corresponding one of said plurality of ribs; wherein said second metal matrix impregnated with super abrasive particles is more durable than the first metal matrix impregnated with super abrasive particles.

In an embodiment, a drill bit comprises: a bit body; a HIP pressed center structure extending from the bit body and formed of a metal matrix impregnated with super abrasive particles, said HIP pressed center structure comprised of a central region located at a center axis of said drill bit and a plurality of finger regions extending radially from said central region; and a plurality of infiltrated ribs extending from the bit body and formed of a metal matrix impregnated with super abrasive particles, wherein certain ones of the plurality of infiltrated ribs form radial extensions of said plurality of finger regions.

In an embodiment, a method comprises: forming a monoblock center structure of a first metal matrix impregnated with super abrasive particles, said monoblock center structure having a central region and a plurality of finger regions extending radially from said central region; placing the monoblock center structure in a center of a bit mold which includes a plurality of inwardly projecting ridge structures defining locations of ribs and fluid channels; filling spaces between the inwardly projecting ridge structures of the bit mold with a powder metallurgy material including super abrasive particles; filling the bit mold with a powder metallurgy material devoid of super abrasive particles; and infiltrating the powder metallurgy materials with a binder to produce from said powder metallurgy material including super abrasive particles a second metal matrix impregnated with super abrasive particles; wherein said first metal matrix impregnated with super abrasive particles is different (for example, more durable) than the second metal matrix impregnated with super abrasive particles.

In an embodiment, a drill bit comprises: a body having an end face configured for engaging a rock formation, said end face defined by: a plurality of ribs separated by a plurality of fluid channels therebetween, said ribs formed of a first metal matrix impregnated with super abrasive particles, wherein proximal ends of all of plurality of ribs terminate without reaching a center of the bit to define a center region of the end face; and a monoblock center structure located at said center region of the end face, said monoblock center structure formed of a second metal matrix impregnated with super abrasive particles; wherein said second metal matrix impregnated with super abrasive particles is different (for example, more durable) than the first metal matrix impregnated with super abrasive particles.

BRIEF DESCRIPTION OF THE DRAWINGS

Other features and advantages of the invention will become clear in the description which follows of several non-limiting examples, with reference to the attached drawings wherein.

DETAILED DESCRIPTION OF THE DRAWINGS

Figure 1:
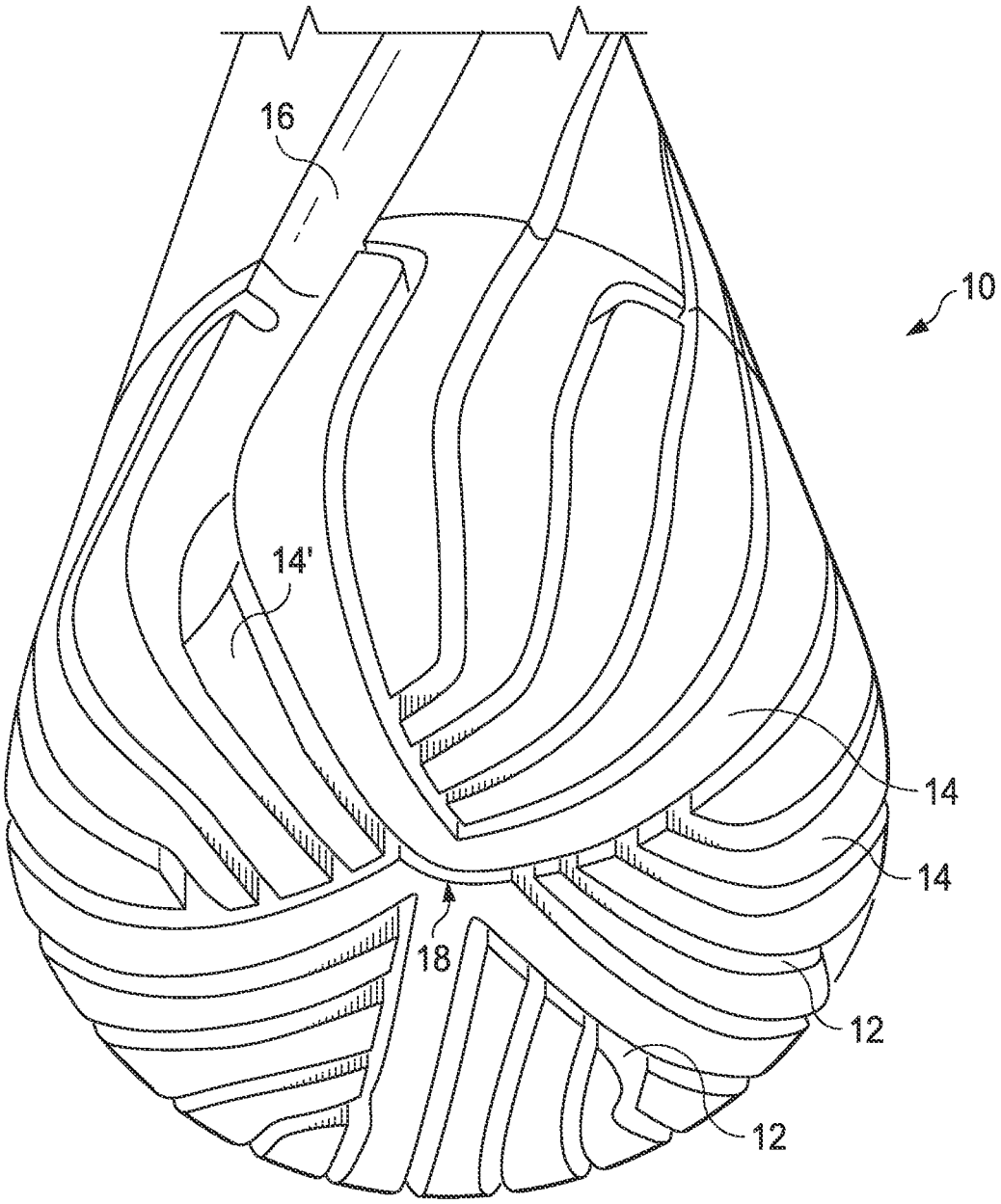
FIG. 1 (PRIOR ART)
FIG. 1 shows a prior art impregnated bit.
Figure 2:
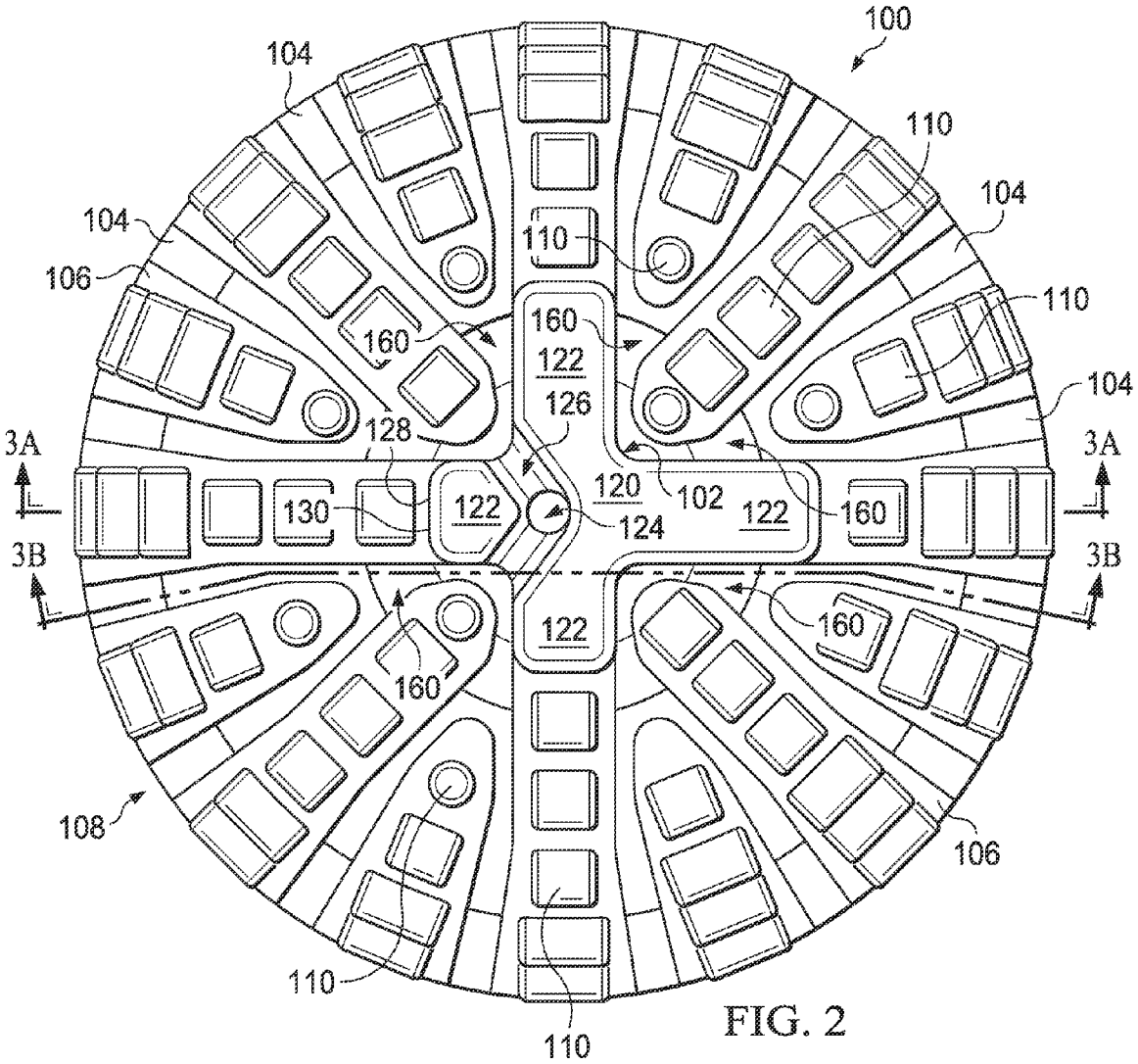
FIG. 2 shows a top view of an embodiment of an impregnated bit with a monoblock center structure.

Reference is now made to FIG. 2 which shows a top view of an embodiment of an impregnated bit 100 with a monoblock center structure 102. The abrasive cutting face of the impregnated bit 100 includes an arrangement of radially extending fluid channels 104. The fluid channels 104 divide the abrasive cutting face of the bit 100 into a plurality of distinct raised ribs 106. The ribs 106 extend outwardly from the monoblock center structure 102 in a radial direction towards the gage 108 of the bit. In this regard it will be noted that the proximal ends of all ribs 106 terminate before reaching the center of the bit face and that the monoblock center structure 102 is provided in a center region of the bit face not occupied by the ribs.

The ribs 106 of the impregnated bit 100 are formed of a metal-matrix composite such as sintered and/or infiltrated tungsten carbide (WC) impregnated with super abrasive particles in the form of diamond material (natural diamond material, synthetic diamond material, thermally stable polycrystalline diamond (TSP) particles, and the like). The metal-matrix composite of sintered or infiltrated diamond impregnated tungsten carbide material for the ribs 106 has, for example, has a hardness in the range of 60 HRa to 65 HRa and a density in the range of 10.8 Kg/L to 11 Kg/L. The bit body (reference 152, FIG. 3A) of the impregnated bit 100 may be formed of a metal-matrix composite such as sintered or infiltrated tungsten carbide (WC). The metal-matrix composite of sintered or infiltrated tungsten carbide material for the bit body 152 has, for example, has a hardness in the range of 60 HRa to 65 HRa and a density in the range of 11.8 Kg/L to 12.2 Kg/L. At the gage 108 of the bit, extensions of the ribs 106 may be formed of infiltrated tungsten carbide (WC) rather than infiltrated tungsten carbide (WC) impregnated with diamond material. The monoblock center structure 102, on the other hand, is formed of a metal-matric composite such as pressed tungsten carbide (WC) impregnated with diamond material (natural diamond material, synthetic diamond material, thermally stable polycrystalline diamond (TSP) particles, and the like). The press operation to form the monoblock center structure 102 may, for example, comprise the use of a hot isostatic press (HIP) as known in the art. The metal-matrix composite of the pressed diamond impregnated tungsten carbide material for the monoblock center structure 102 has, for example, has a hardness in the range of 77 HRa to 81 HRa and a density in the range of 12.4 Kg/L to 12.8 Kg/L. It will accordingly be noted that the monoblock center structure 102 is formed of a harder and denser metal-matrix composite material than the ribs 106. This configuration advantageously places a more durable/efficient (for example, more wear resistant) metal-matrix structure in the form of the monoblock center structure 102 at the center of the bit 100. Specific changes in the quantities of the components (tungsten, carbide, binder) and the powder metallurgical process used (hot-pressing, sintering, infiltration) as known to those skilled in the art allow for control to be exercised over the hardness, toughness, erosion and abrasion resistance, and other properties of the metal-matrix composite used for the ribs, 106, bit body 152, and monoblock center structure 102.

In an embodiment, the relative super abrasive particle content of the monoblock center structure 102 and ribs 106 may be different. For example, the metal-matrix composite material for the monoblock center structure 102 may have a diamond content of 10% to 30% while the metal-matrix composite material for the ribs 106 may have a diamond content of 15% to 35%.

The abrasive cutting surface of the bit 100 is defined in part by the top surface of the ribs 106. The abrasive cutting surface of the bit 100 is further defined in part by the top surface of the monoblock center structure 102. The abrasive cutting surface of the bit 100 is still further defined in part by a plurality of abrasive cutting inserts 110. The inserts 110 are mounted along a radial length of the each rib 106. The cutting inserts 110 may have a cylindrical shape or other shape as known in the art. In an embodiment, the inserts 110 comprise sintered tungsten carbide (WC) impregnated with diamond material (natural diamond material, synthetic diamond material, thermally stable polycrystalline diamond (TSP) particles, and the like). In another embodiment, the inserts 110 comprise pressed tungsten carbide (WC) impregnated with diamond material (natural diamond material, synthetic diamond material, thermally stable polycrystalline diamond (TSP) particles, and the like).

Figure 5:
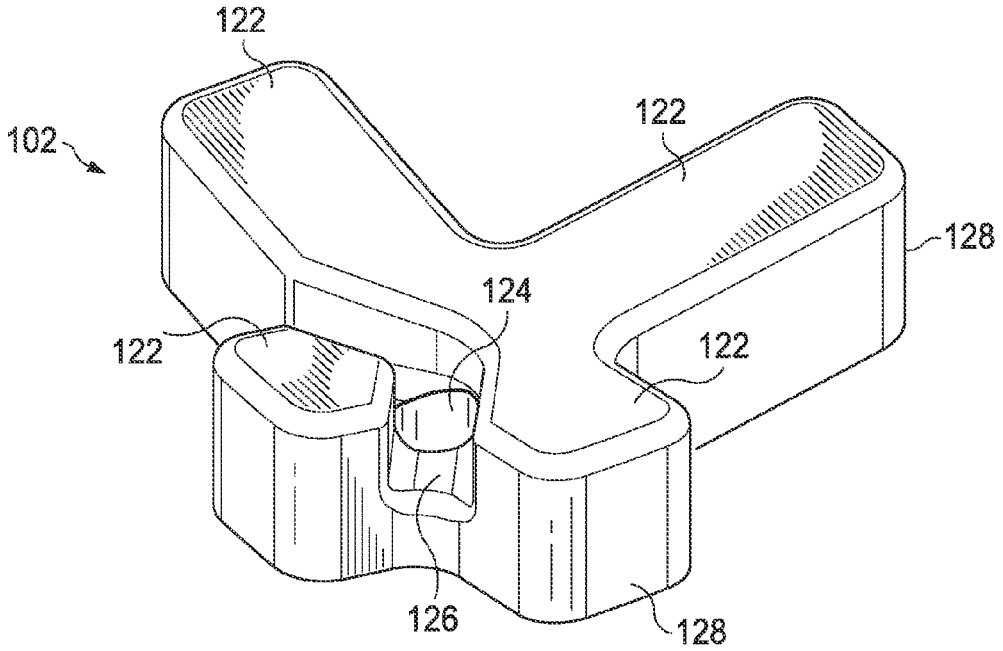
FIG. 5 is a perspective view of monoblock center structure used with the impregnated bit of FIG. 2.

The monoblock center structure 102 includes a central region 120 and a plurality of radially extending finger regions 122 which extend from that central region 120. See, also, FIG. 5. A fluid aperture 124 is formed in the central region 120 (at or near a center axis of the bit 100), that fluid aperture extending generally parallel to the center axis (reference 170, FIG. 3A) of the bit and passing completely through the monoblock center structure 102. At least one fluid channel 126 is formed in the top surface of the monoblock center structure 124 extending in a generally radial direction outwardly from the fluid aperture 124 to connect to one of the fluid channels 104 that extend between adjacent ribs 106. The fluid channel 126 has a depth that is less than the thickness of the monoblock center structure 102 at the central region 120. Thus the central region 120 and plurality of radially extending finger regions 122 are integrally formed.

Each finger region 122 of the monoblock center structure 102 terminates at a distal end 128. That distal end 128 is adjacent a proximal end 130 of a corresponding and radially aligned rib 106, that rib accordingly forming a radial extension of the finger region. A height of the monoblock center structure 102 at the distal end 128 of the finger region 122 preferably exceeds the height of the radially aligned rib 106 at the proximal end 130 (reference 174, FIGS. 3A and 3B) and may correspond to an exposure height of the abrasive cutting insert 110 on the radially aligned rib 106 at a position closest to the proximal end 130 (reference 176, FIGS. 3A and 3B). The height of the monoblock center structure 102 at the central region 120 may be less than the height of the monoblock center structure 102 at the distal end 128 of the finger region 122. At the distal end 128, the finger regions 122 have a width which substantially matches a width of the radially aligned rib 106 at the proximal end 130.

Figure 3A:
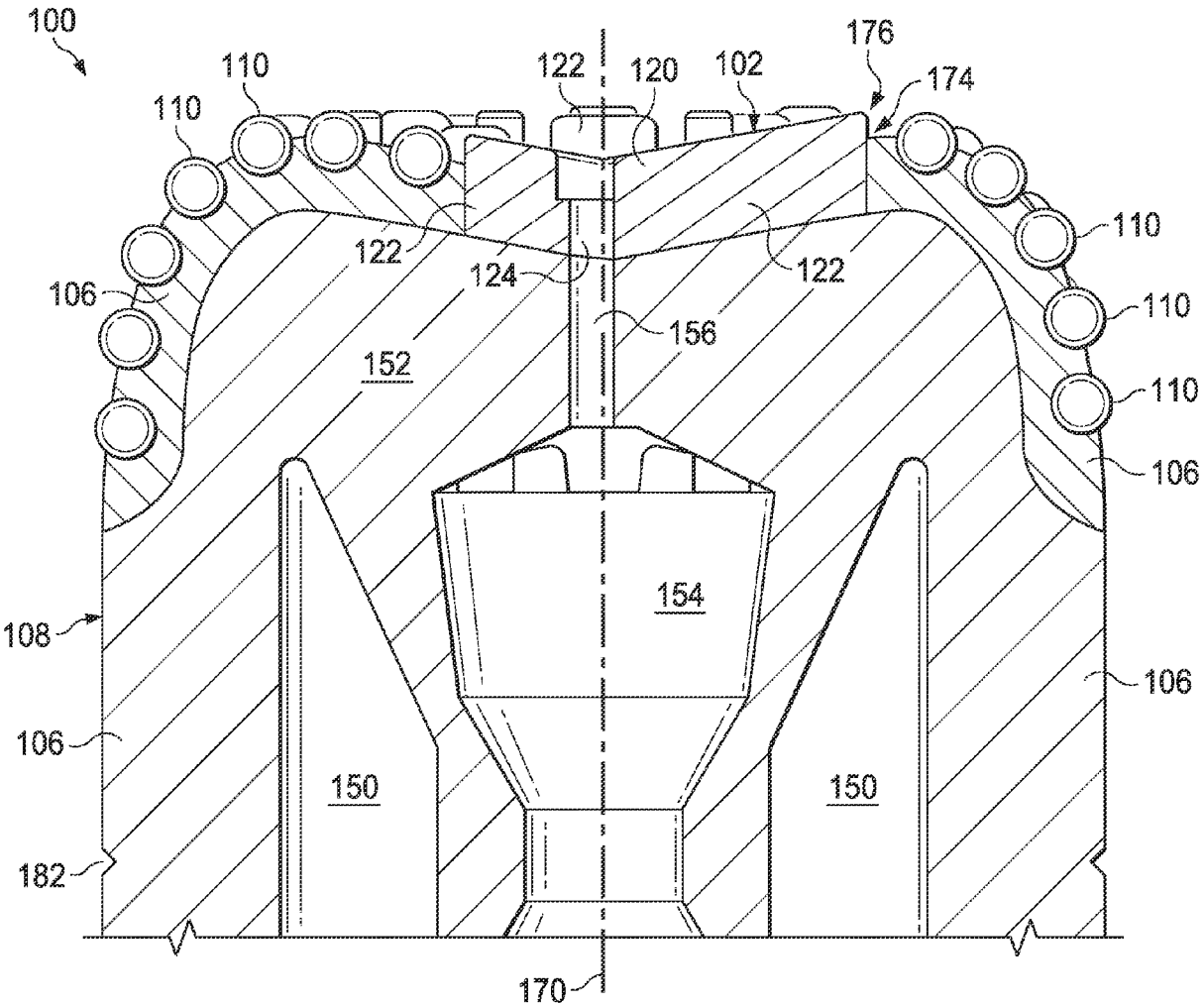
FIG. 3A is a cross-section taken through lines A-A of FIG. 2.

Reference is now made to FIG. 3A which illustrates a cross-section of the impregnated bit 100 taken through lines A-A of FIG. 2. This cross-section passes through the center axis 170 of the bit 100. The bit 100 includes a blank portion 150. The infiltrated tungsten carbide material defining the bit body 152 and the infiltrated diamond impregnated tungsten carbide material defining the ribs 106 surround the blank portion 150. A central plenum 154 is provided within the bit body 152. A central passage 156 is provided to couple the central plenum 154 to the fluid aperture 124 formed in the central region 120 of the monoblock center structure 102.

Figure 3B:
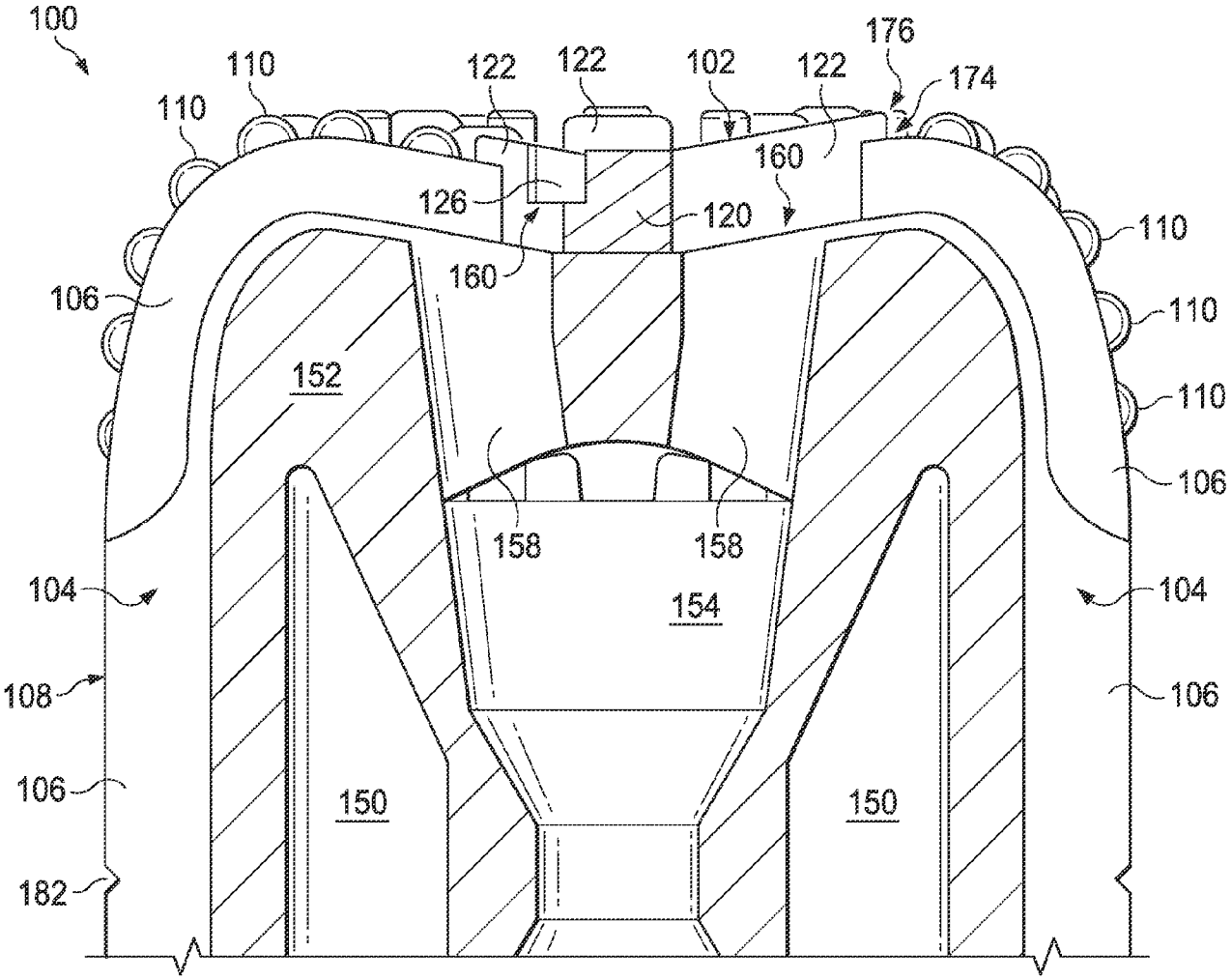
FIG. 3B is a cross-section taken through lines B-B of FIG. 2.

Reference is now made to FIG. 3B which illustrates a cross-section of the impregnated bit 100 taken through lines B-B of FIG. 2. This cross-section passes in a manner offset from the center axis 170 of the bit 100 and through the radially extending fluid channels 104. A plurality of offset passages 158 are provided to couple the central plenum 154 to fluid exit passages 160 (see, also, FIG. 2) provided at the face of the bit 100 between the monoblock center structure 102 and the ribs 106.

Figure 4:
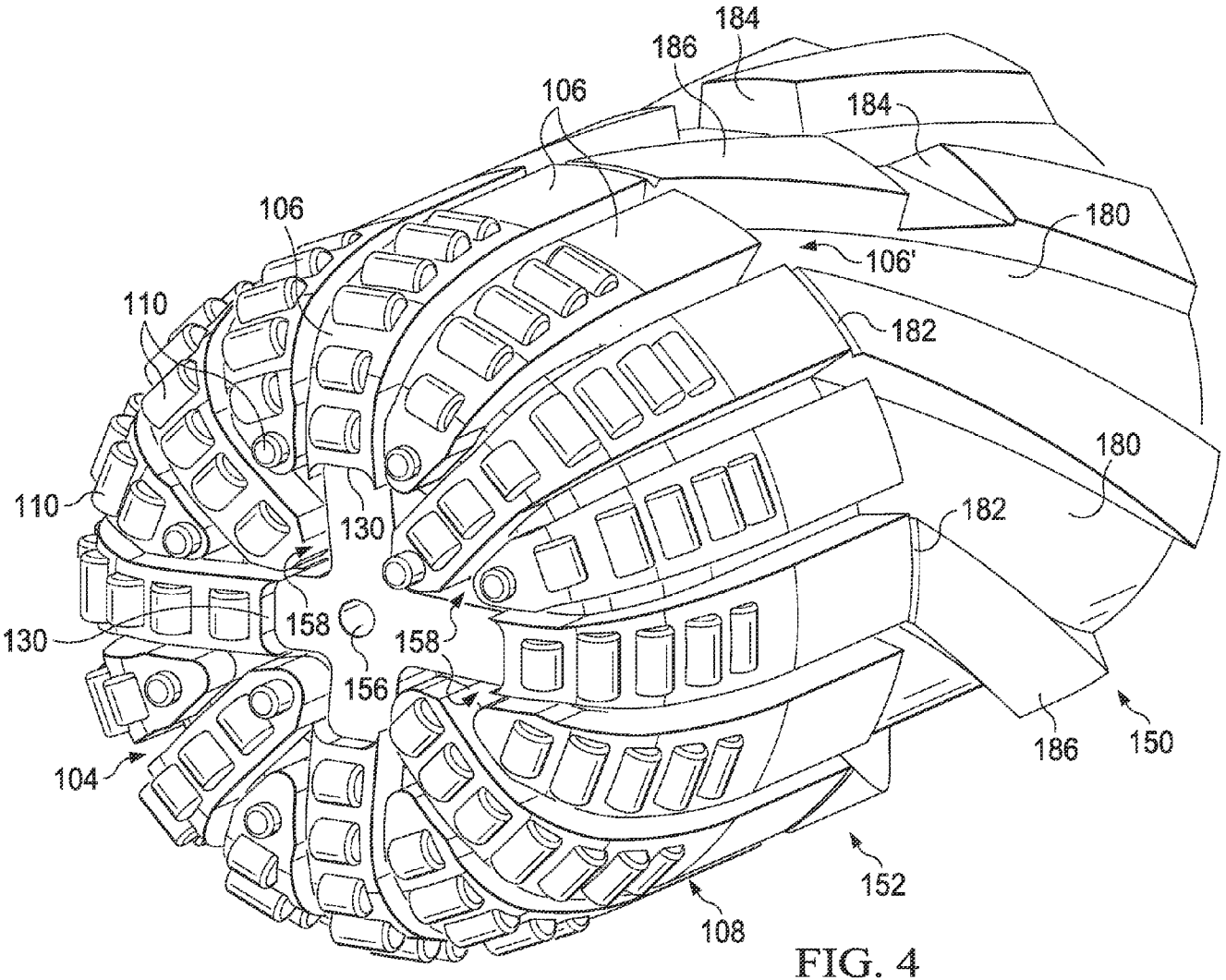
FIG. 4 is a perspective view of the impregnated bit of FIG. 2 without the monoblock center structure in place.

Reference is now made to FIG. 4 which illustrates a perspective view of the impregnated bit 100 of FIG. 2 without the monoblock center structure 102 in place. The removal of the monoblock center structure 102 in FIG. 4 permits the relative positioning of the central passage 156 and offset passages 158 to be visualized. The fluid exit passages 160 (see, also, FIG. 2) are positioned between the proximal ends of the ribs 104 (which are not radially aligned with finger regions 122) and the monoblock center structure 102.

All or a portion of a rib 106 may be removed (reference 106') at or near the gage 108 of the bit 100 to define a gap 180. The gap 180 provides a wider fluid course than is provided by any one of the fluid channels 104. The gap 180 is provided as part of the bit sleeve 152. Circumferential line 182 illustrates a parting or separation line in the mold used to form the bit 100 and distinguishes between the mold part used to define the front of the bit including the ribs 106 and the mold part used to define the back of the bit including the gap 180. Tool slots 184 may be provided in the rib extensions 186 formed at the back of the bit. In an embodiment, the rib extensions 186 have a spiral configuration.

Figure 6:
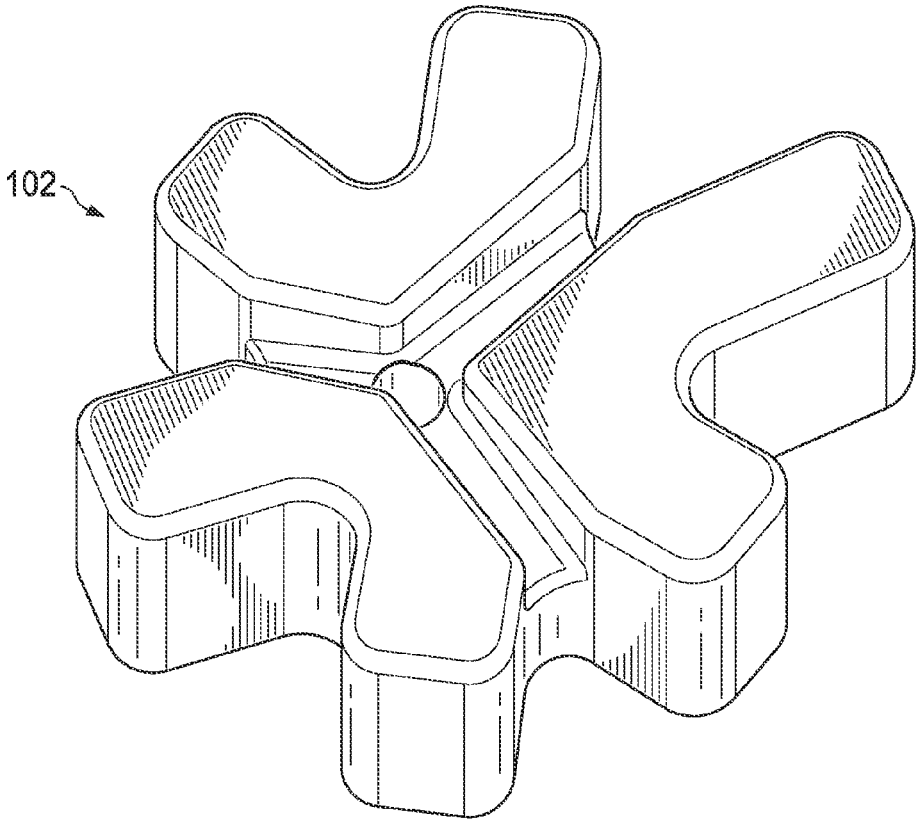
FIGS. 6-8 are perspective views of alternative embodiments of a monoblock center structure for use with an impregnated bit like that shown in FIG. 2.
Figure 7:
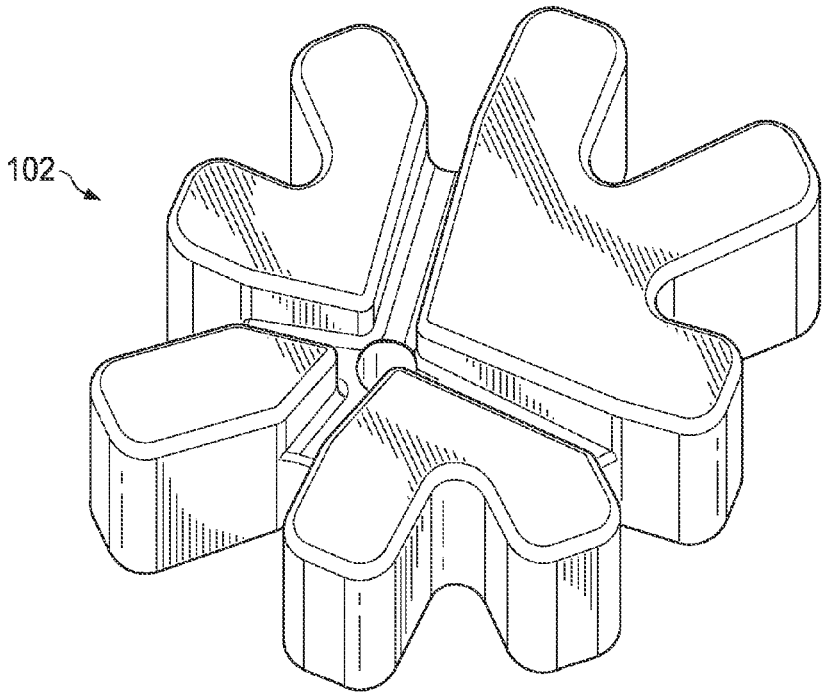
Figure 8:
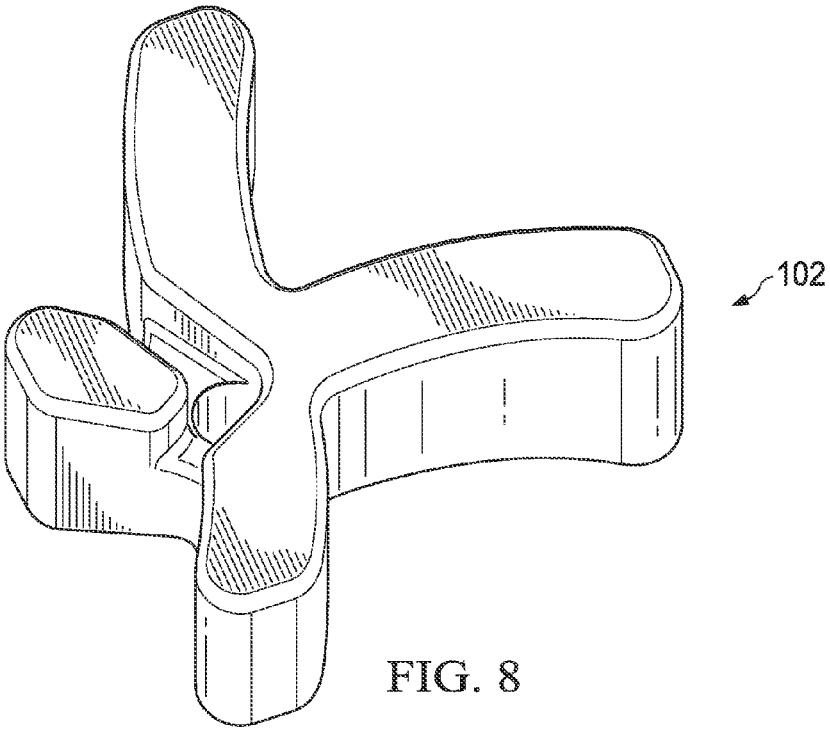

Reference is now made to FIGS. 6-8 will illustrate perspective views of alternative embodiments of a monoblock center structure 102 for use with an impregnated bit like that shown in FIG. 2. The monoblock center structures 102 of FIGS. 6-7 differ from the monoblock center structure 102 of FIG. 5 in terms of the number of included finger regions 122. The monoblock center structure 102 of FIG. 8 differs from the monoblock center structures 102 of FIGS. 5-7 in that the finger regions 122 are provided with a spiral curve instead of a straight radial extension. In connection with the use of the monoblock center structure 102 of FIG. 8, a preferred embodiment would correspondingly use spirally extending ribs 106.

Reference is now made to FIGS. 9A-9F which illustrate process steps in the manufacture of the impregnated bit of FIG. 2. The illustrations are simplified to emphasize important features. The details of the bit molding process using powder metallurgy techniques are well known in the art.

Figure 9A:
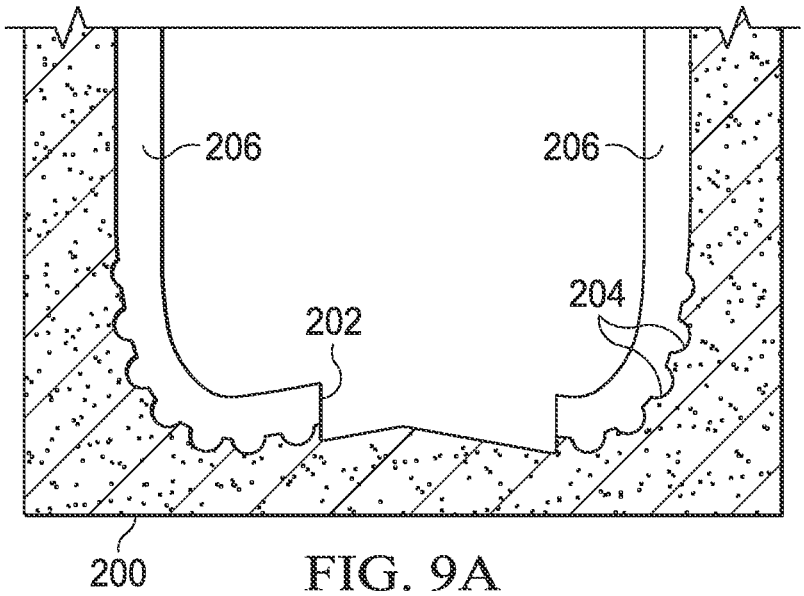
FIGS. 9A-9F illustrate process steps in the manufacture of the impregnated bit of FIG. 2.

FIG. 9A shows a bit mold 200, for example formed of a graphite material, having a bowl-shape generally corresponding to the shape of the face of the bit to be made and including a first recess 202 and a plurality of second recesses 204. The bit mold 200 is further formed with inwardly projecting ridge structures 206 configured to define the locations of the fluid channels 104 and ribs 106.

Figure 9B:
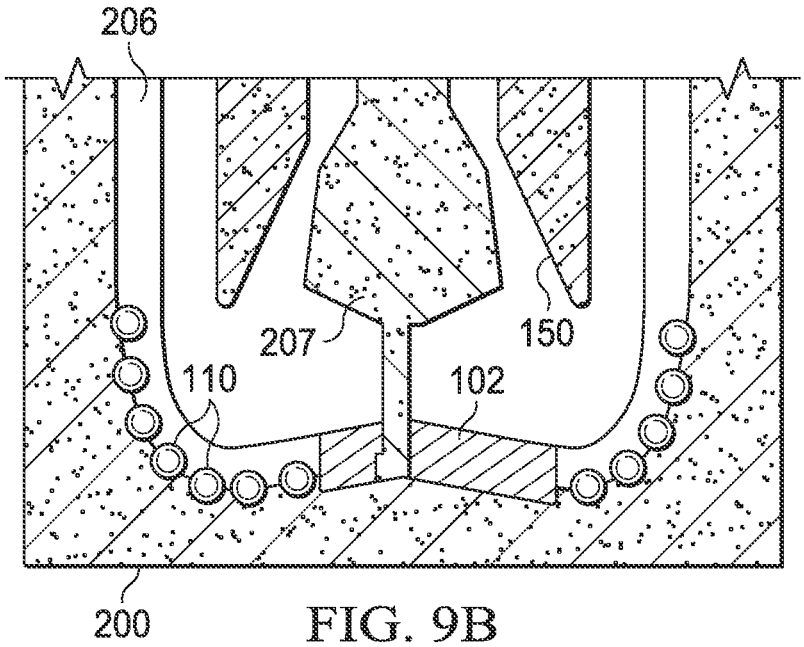

FIG. 9B shows the installation within the bit mold 200 of the monoblock center structure 102 in the first recess 202 along with the installation of abrasive cutting inserts 110 in the plurality of second recesses 204. The monoblock center structure 102 is a preformed metal-matrix body made of pressed tungsten carbide (WC) impregnated with diamond material (natural diamond material, synthetic diamond material, thermally stable polycrystalline diamond (TSP) particles, and the like). The press operation to form the monoblock center structure 102 may, for example, comprise the use of a hot isostatic press (HIP) as known in the art.

The abrasive cutting inserts 110 are likewise preformed metal-matrix structures impregnated with super abrasive material of known configuration in the art. As an alternative embodiment, the inserts 110 may be omitted.

FIG. 9B further shows the installation within the bit mold 200 of the plenum blank 207 and blank portion 150. Techniques for suspending the plenum blank 207 and blank portion 150 within the bit mold 200 are well known in the art. The plenum blank 207 defines the location of the central plenum 154, central passage 156 and offset passages 158.

Figure 9C:
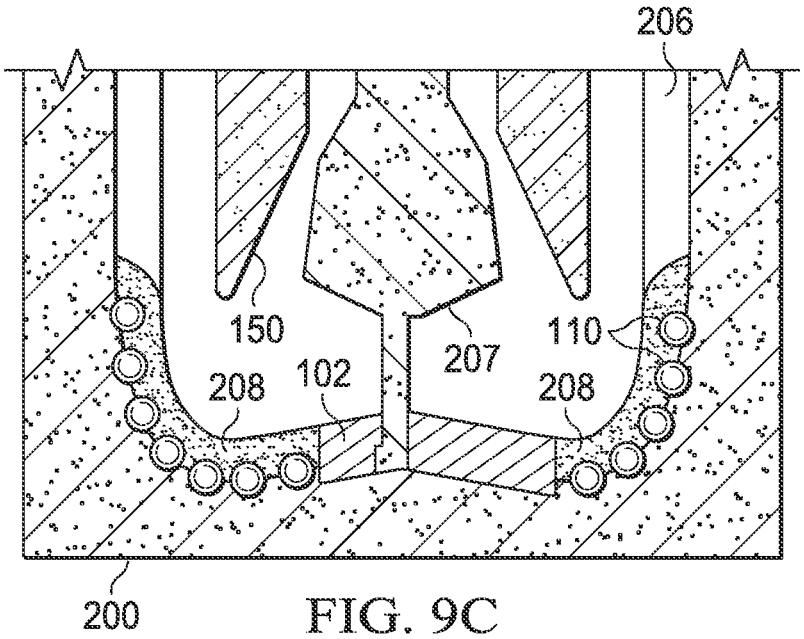

FIG. 9C shows the deposit of powder tungsten carbide material including diamond, generally indicated at reference 208, within the bit mold 200 at the face of the bit (between ridge structures 206) to be made in the ribs 106 surrounding the abrasive cutting inserts 110. The material 208 extends outwardly from the monoblock center structure 102 to the gage region. If the inserts 110 are omitted, the material 208 will fill the second recesses 204. In a preferred embodiment, only the portions of the mold associated with defining ribs 106 receive the material 208.

Figure 9D:
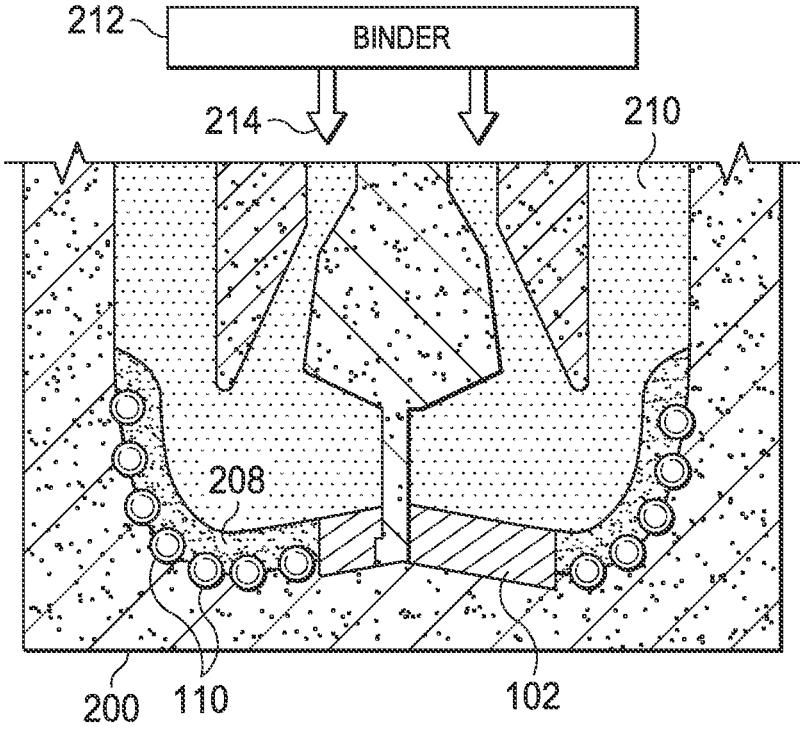

FIG. 9D shows the deposit of powdered tungsten carbide material, generally indicated at reference 210, within the bit mold 200. The material 210 fills the bit mold 200 and thus covers the previously deposited material 208 and surrounds the plenum blank 207 and blank portion 150. A binder material 212 is placed over and in contact with the material 210.

A sintering or infiltration process is then performed to melt the binder material 212 so that it infiltrates 214 into the material 210 and the material 208. The metal-matrix formed by this process secures the monoblock center structure 102 and included inserts 110.

Figure 9E:
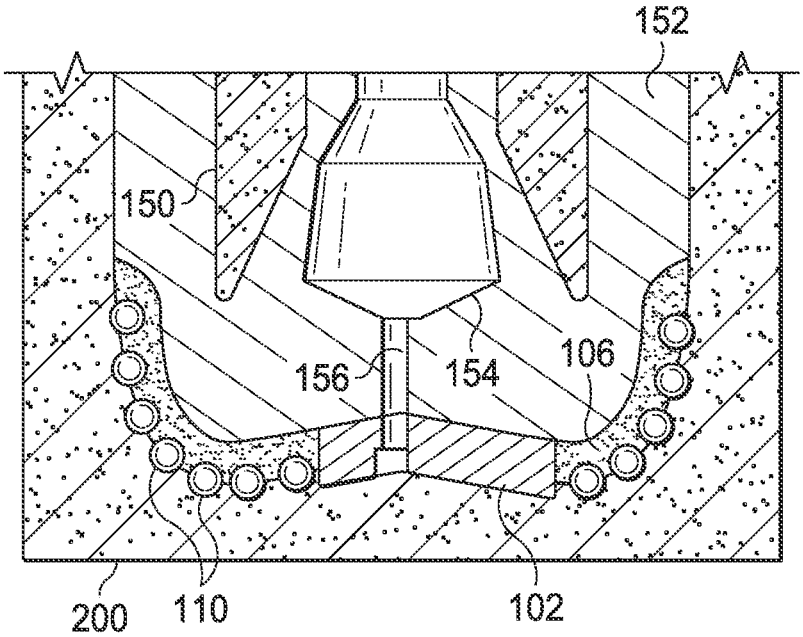

The result of the sintering or infiltration process is shown in FIG. 9E. The powder tungsten carbide materials 208 and 210 are converted to metal-matrix structures that define the ribs 106 and bit body 152 and surround the blank portion 150. The plenum blank is destroyed to provide the central plenum 154, central passage 156 and offset passages 158.

Figure 9F:
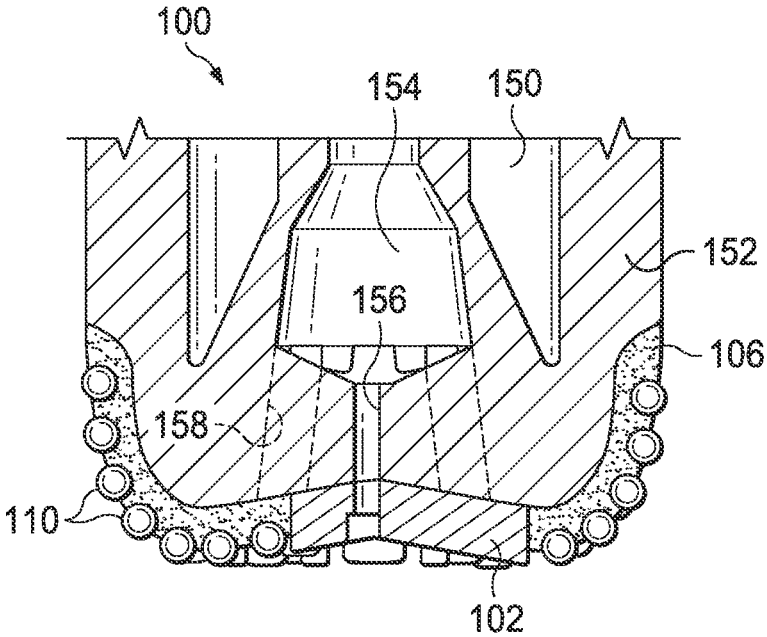

The molded bit 100 is then released from the bit mold 200 with a configuration as shown in FIG. 9F (see also, the corresponding cross section of FIG. 3A).

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A drill bit, comprising:

an outer gage;

a bit body having an end with a conical inner region and a shoulder disposed between the conical inner region and the outer gage;

a cutting face attached to the end of the bit body and comprising:

a monoblock insert contained within the conical inner region, formed of a first metal matrix impregnated with super abrasive particles, and having a central region occupying a center of the cutting face and a plurality of finger regions extending from the central region;

a plurality of ribs extending outwardly from the monoblock insert to the outer gage and formed of a second metal matrix impregnated with super abrasive particles; and a plurality of fluid channels formed between adjacent ribs, wherein:

the monoblock insert has a density and a hardness greater than a density and a hardness of the ribs, and some of the ribs correspond to the finger portions such that each corresponding rib is aligned with and has an end located adjacent to the respective finger region.

2. The drill bit of claim 1, further including a plenum formed in the bit body, the central region of the monoblock insert including a center opening in fluid communication with the plenum via a central passage formed in the bit body.

3. The drill bit of claim 2, further including a fluid channel formed in the monoblock insert and extending outwardly from the center opening.

4. The drill bit of claim 3, wherein the fluid channel of the monoblock insert is in fluid communication with one of the fluid channels formed between the ribs.

5. The drill bit of claim 4, further including a plurality of exit passages formed in the cutting face between the monoblock insert and the ribs, the exit passages in fluid communication with the plenum via offset passages formed in the bit body.

6. The drill bit of claim 1, wherein the finger regions and the ribs are each radially extending.

7. The drill bit of claim 1, wherein the finger regions and the ribs are each spirally extending.

8. The drill bit of claim 1, wherein the density of the monoblock insert ranges between 1.13-1.19 times the density of the ribs.

9. The drill bit of claim 1, wherein the hardness of the monoblock insert ranges between 1.18-1.35 times the hardness of the ribs.

10. The drill bit of claim 1, further comprising a plurality of cutting inserts mounted along each of the ribs, wherein each of the inserts is impregnated with super abrasive particles.

11. The drill bit of claim 10, wherein a height of the monoblock insert at a distal end of each finger portion corresponds to an exposure height of a respective adjacent one of the cutting inserts.

12. The drill bit of claim 1, wherein a width of each finger portion at a distal end thereof matches a width of the respective corresponding rib.

13. The drill bit of claim 1, further comprising a plurality of rib extensions extending along the outer gage.

14. The drill bit of claim 13, wherein a number of the rib extensions is less than a number of the ribs such that a gap is formed along the outer gage.

* * * * *